US010327285B2

(12) United States Patent
Seong et al.

(10) Patent No.: US 10,327,285 B2
(45) Date of Patent: Jun. 18, 2019

(54) HEATING ELEMENT AND METHOD FOR MANUFACTURING SAME

(71) Applicant: LG CHEM, LTD., Seoul (KR)

(72) Inventors: Jiehyun Seong, Daejeon (KR); Hyeon Choi, Daejeon (KR); Sarah Kim, Daejeon (KR); Seung Heon Lee, Daejeon (KR)

(73) Assignee: LG CHEM, LTD., Seoul (KR)

( * ) Notice: Subject to any disclaimer, the term of this patent is extended or adjusted under 35 U.S.C. 154(b) by 5 days.

(21) Appl. No.: 15/033,370

(22) PCT Filed: Nov. 27, 2014

(86) PCT No.: PCT/KR2014/011464
§ 371 (c)(1),
(2) Date: Apr. 29, 2016

(87) PCT Pub. No.: WO2015/080482
PCT Pub. Date: Jun. 4, 2015

(65) Prior Publication Data

US 2016/0278166 A1 Sep. 22, 2016

(30) Foreign Application Priority Data

Nov. 29, 2013 (KR) ..... 10-2013-0147153

(51) Int. Cl.

| | |
|---|---|
| ***H05B 1/02*** | (2006.01) |
| ***H05B 3/84*** | (2006.01) |
| ***H05B 3/26*** | (2006.01) |
| ***H05B 3/00*** | (2006.01) |

(52) U.S. Cl.
CPC ..... *H05B 3/84* (2013.01); *H05B 1/0236* (2013.01); *H05B 3/0014* (2013.01); *H05B 3/26* (2013.01); *H05B 2203/002* (2013.01); *H05B 2203/013* (2013.01)

(58) Field of Classification Search
CPC ..... H05B 3/84; H05B 3/0042; H05B 1/0236; H05B 2003/013; H05B 2203/031; H05B 2214/02; H05B 3/86; H95B 3/0014; H05H 3/14
USPC ..... 219/202, 203, 542, 543
See application file for complete search history.

(56) References Cited

U.S. PATENT DOCUMENTS

| | | | | |
|---|---|---|---|---|
| 4,707,586 A * | 11/1987 | Voss | B32B 17/10036 219/203 |
| 4,920,254 A * | 4/1990 | DeCamp | B64C 1/1492 219/203 |
| 6,708,595 B1 * | 3/2004 | Chaussade | B32B 17/10064 428/911 |
| 9,247,587 B2 * | 1/2016 | Kim | H01C 17/00 |
| 9,560,697 B2 * | 1/2017 | Junghans | H05B 3/34 |

(Continued)

FOREIGN PATENT DOCUMENTS

| | | |
|---|---|---|
| CN | 101977863 | 2/2011 |
| EP | 2450915 | 5/2012 |

(Continued)

*Primary Examiner* — Mark H Paschall
(74) *Attorney, Agent, or Firm* — Dentons US LLP

(57) ABSTRACT

The present specification provides a heating element including an adhesive film; and a conductive heating pattern provided on at least one surface of the adhesive film and having a line height of 10 micrometers or less, and a method for fabricating the same.

16 Claims, 5 Drawing Sheets

(56) References Cited

U.S. PATENT DOCUMENTS

| | | | | |
|---|---|---|---|---|
| 2004/0016738 | A1* | 1/2004 | Bartrug | B32B 3/10 219/203 |
| 2009/0057295 | A1 | 3/2009 | Han et al. | |
| 2009/0233121 | A1* | 9/2009 | Leconte | B32B 17/10 428/626 |
| 2010/0000981 | A1* | 1/2010 | Diemer | H05B 3/146 219/202 |
| 2010/0213189 | A1* | 8/2010 | Keite-Telgenbuescher | B60R 1/0602 219/548 |
| 2011/0017719 | A1 | 1/2011 | Choi et al. | |
| 2011/0062146 | A1 | 3/2011 | Kuriki | |
| 2011/0233194 | A1 | 9/2011 | Choi et al. | |
| 2011/0318580 | A1 | 12/2011 | Choi et al. | |
| 2012/0067641 | A1* | 3/2012 | Tokiwa | H01Q 1/1278 174/84 R |
| 2012/0261404 | A1* | 10/2012 | Choi | H05B 3/84 219/522 |
| 2013/0327757 | A1 | 12/2013 | Kim et al. | |

FOREIGN PATENT DOCUMENTS

| | | | |
|---|---|---|---|
| EP | 2521422 | | 11/2012 |
| EP | 2665337 | | 11/2013 |
| KR | 10-2010-0099627 | A | 9/2010 |
| KR | 10-2011-0076837 | A | 7/2011 |
| KR | 10-2012-0090790 | A | 8/2012 |

* cited by examiner

HEATING ELEMENT AND METHOD FOR MANUFACTURING SAME

This application is a National Stage Entry of International Application No. PCT/KR2014/011464, filed on Nov. 27, 2014, and claims the benefit of and priority to Korean Application No. 10-2013-0147153, filed on Nov. 29, 2013, both of which are incorporated herein by reference in their entirety for all purposes as if fully set forth herein.

TECHNICAL FIELD

This application claims priority to and the benefits of Korean Patent Application No. 10-2013-0147153, filed with the Korean Intellectual Property Office on Nov. 29, 2013, the entire contents of which are incorporated herein by reference.

The present disclosure relates to a heating element and a method for fabricating the same.

BACKGROUND ART

Moisture or frost is formed on the windows of a vehicle when there is a temperature difference between the outside and the inside of the vehicle. Heating glass may be used in order to solve this problem. Heating glass uses a concept of generating heat from a heating line by attaching a heating line sheet to the glass surface or directly forming a heating line on the glass surface and applying electric power to both terminals of the heating line, and thereby increasing a temperature of the glass surface.

Particularly, methods employed for providing heating to vehicle front windows while having excellent optical properties are largely divided into two types.

The first method is forming a transparent conductive thin film on the whole window surface. The method of forming the transparent conductive thin film includes a method of increasing transparency by using a transparent conductive oxide film such as ITO, or by forming a thin metal layer and then using transparent insulation films above and below the metal layer. This method has an advantage in that an optically superior conductive film may be formed, however, there is a disadvantage in that a proper heating value may not be obtained at low voltage due to relatively high resistance.

The second method may use a method of using a metal pattern or wire, and increasing transparency by maximizing a region having no patterns or wires. Typical products using this method include a heating glass produced by inserting a tungsten wire to a PVB film used for bonding vehicle front windows. In this case, the diameter of the used tungsten wire is 18 micrometers or greater, and conductivity capable of securing a sufficient heating value at low voltage may be obtained, however, there is a disadvantage in that the tungsten line is noticeable due to the relatively high thickness of the tungsten line. In order to overcome this problem, a metal pattern may be formed on a PET film through a printing process, or a metal pattern is formed through a photolithography process after attaching a metal layer on a PET film. A heating product capable of heating may be produced by inserting the metal pattern-formed PET film between two PVB films, and then going through a glass bonding process. However, there is a disadvantage in that a PET film is inserted between two PVB films, and therefore, there may be a distortion in the objects seen through vehicle windows due to a refractive index difference between the PET film and the PVB film.

DISCLOSURE

Technical Problem

The present specification describes a heating element and a method for fabricating the same.

Technical Solution

One embodiment of the present invention provides a heating element including an adhesive film; and a conductive heating pattern provided on at least one surface of the adhesive film and having a line height of 10 micrometers or less.

Another embodiment of the present invention provides a heating element including an adhesive film; a conductive heating pattern provided on at least one surface of the adhesive film and having a line height of 10 micrometers or less; and a protective film provided on at least one surface of the surface provided with the conductive heating pattern of the adhesive film, and a surface opposite to the surface provided with the conductive heating pattern of the adhesive film.

Still another embodiment of the present invention provides a heating element including an adhesive film; a conductive heating pattern provided on at least one surface of the adhesive film and having a line height of 10 micrometers or less; a first transparent substrate provided on the surface provided with the conductive heating pattern of the adhesive film; and a second transparent substrate provided on a surface opposite to the surface provided with the conductive heating pattern of the adhesive film.

The heating element may further include an additional adhesive film provided on the surface provided with the conductive heating pattern of the adhesive film.

The heating element may further include bus bars provided at both ends of the conductive heating pattern. In addition, the heating element may further include a power unit connected to the bus bars.

Still another embodiment of the present invention provides a method for fabricating a heating element including forming a conductive heating pattern having a line height of 10 micrometers or less on at least one surface of an adhesive film.

Still another embodiment of the present invention provides a method for fabricating a heating element including heat bonding a metal film having a thickness of 10 micrometers or less on at least one surface of an adhesive film; and forming a conductive heating pattern by patterning the metal film.

Still another embodiment of the present invention provides a method for fabricating a heating element including forming a metal plating pattern having a thickness of 10 micrometers or less on a metal layer; laminating the metal layer provided with the metal plating pattern with an adhesive film so that the metal plating pattern is in contact with the adhesive film; and removing the metal layer from the metal plating pattern.

Advantageous Effects

According to embodiments described in the present specification, a conductive heating pattern may be formed on an adhesive film without a transparent substrate. Thus, a conductive heating pattern is directly formed on an adhesive film, and no films are additionally used other than the adhesive film between two transparent substrates, and as a result, view distortion caused by a refractive index difference between the films may be prevented. In addition, when only one adhesive film is used, there is an advantage in that a heating element fabricating process is simple, fabricating costs are low, and a thin heating element can be formed. Meanwhile, a heating element according to some embodiments of the present specification may further include an additional adhesive film provided on the surface provided with the conductive heating pattern of the adhesive film, and in this case, a view distortion phenomenon caused by a refractive index difference and a problem of bubble removal in a bonding process can be prevented.

MODE FOR DISCLOSURE

Hereinafter, the present invention will be described in more detail.

A heating element according to one embodiment of the present invention includes an adhesive film; and a conductive heating pattern provided on at least one surface of the adhesive film and having a line height of 10 micrometers or less.

In the present specification, the line height of the conductive heating pattern means a distance from a surface in contact with the adhesive film, to a surface opposite thereto.

Figure 1:
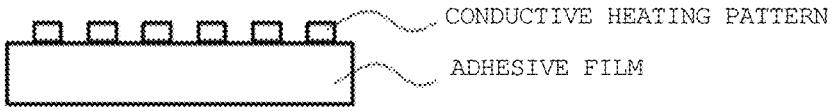
FIG. 1 illustrates a laminated structure in a heating element according to one embodiment described in the present specification.

FIG. 1 illustrates a laminated structure of the heating element. A method of forming a conductive heating pattern on a transparent substrate has been used in the art, however, a conductive heating pattern may be directly formed on an adhesive film without a transparent substrate according to the present invention.

A heating element according to one embodiment of the present invention may be formed after forming a metal film having a thickness of 10 micrometers or less on at least one surface of an adhesive film, through patterning the metal film using a method such as an etching process. The formation of the metal film may be carried out after forming a metal plating layer having a thickness of 10 micrometers or less on a metal layer, through transferring the result on an adhesive film. Alternatively, a heating element according to one embodiment of the present invention may be formed after forming a metal plating pattern having a thickness of 10 micrometers or less on a metal layer, through transferring the metal plating pattern on an adhesive film.

The adhesive film means having an adhesive property at a temperature higher than a process temperature used in a thermal bonding process. For example, the adhesive film means having an adhesive property with a transparent substrate in a thermal bonding process used for fabricating a heating element in the art. The pressure, temperature, and time of the thermal bonding process are different depending on the types of an adhesive film, however, for example, the thermal bonding process may be carried out at a temperature selected from a range between 130 and 150° C., and pressure may be applied as necessary. Polyvinylbutyral (PVB), ethylene vinyl acetate (EVA), polyurethane (PU), Polyolefin (PO) and the like may be used as the materials of the adhesive film, however, the material is not limited to these examples.

The adhesive film has an adhesive property at a temperature higher than a process temperature used in a thermal bonding process, and therefore, no additional adhesive films are required in the bonding with a transparent substrate later. An adhesive film having an adhesive property at high temperatures such as above has a film material with a low glass transition temperature, therefore, the film may be deformed or damaged to undesirable forms. The present invention may form a conductive heating pattern may be formed at low temperatures using a plating method to be described later, and accordingly, a heating element including an adhesive film having an adhesive property in a thermal bonding process may be provided.

In one embodiment of the present invention, a freestanding metal film is formed by forming a metal plating layer or a metal plating pattern having a thickness of 10 micrometers or less using a plating method, and a heating element may be formed by transferring the result on an adhesive film. A freestanding metal film in the present specification means a metal film formed separately from an adhesive film, and the form may be either before or after forming a pattern corresponding to a conductive heating pattern. In the case that the freestanding metal film means after forming a pattern, the freestanding metal film may be used to have the same meaning as a conductive heating pattern. Transferring to the adhesive film may be carried out through a lamination process passing the adhesive film and the freestanding metal film through a heating roll. The temperature used for the heating roll may be selected from within a [glass transition temperature of an adhesive film—10° C.] or higher, or a [temperature used in a bonding process with a transparent substrate] or less. The [temperature used in a bonding process with a transparent substrate] may be a temperature selected from a range of, for example, 130 to 150° C. Herein, a constant pressure may be applied between the rolls as necessary.

The metal film in the form of the freestanding film may be formed using a rolling method or plating method mostly. However, it is difficult to form a uniform thin film having a thickness of 10 micrometers or less using a rolling method, therefore, when a conductive heating pattern is formed, a pattern having a line height of 10 micrometers or less may not be obtained when a metal film prepared using a rolling method is used. However, in the present invention, a freestanding metal film using a plating method to be described later is used, and therefore, a conductive heating pattern having a line height of 10 micrometers or less may be formed.

In the case that a method of directly forming a metal thin film on an adhesive film is used instead of using a method of fusing a metal form in the form of a freestanding film on an adhesive film, a uniform metal thin film may be difficult to be formed on the adhesive film when exposed to a temperature exceeding a temperature used in a bonding process between the adhesive film and a transparent substrate. For example, when a thin film having a thickness of 300 nm or greater is formed using a vacuum deposition process, thermal stress may be given to the adhesive film, and when the temperature temporarily increases to a glass transition temperature of the adhesive film or higher, the adhesive film may be deformed. Particularly, when the adhesive film is deformed during a film rolling process, a uniform metal thin film is difficult to be formed on the adhesive film.

However, as described above, the present invention uses a method of forming a freestanding metal film by forming a metal plating pattern or a metal plating layer having a thickness of 10 micrometers or less on a metal layer using a plating method, and transferring the result on an adhesive film, and therefore, a conductive heating pattern having a uniform thickness may be formed while preventing the deformation of the adhesive film.

According to one embodiment of the present invention, the thickness of the adhesive film is 190 to 2,000 micrometers. When the thickness of the adhesive film is 190 micrometers or greater, sufficient adhesive strength with a transparent substrate may be obtained later while stably supporting the conductive heating pattern. Even when the thickness of the adhesive film is 2,000 micrometers or less, sufficient supporting and adhesive properties are obtained as described above, therefore, an unnecessary thickness increase may be prevented.

According to one embodiment of the present invention, the glass transition temperature (Tg) of the adhesive film is 55 to 90° C. Even in the case that the adhesive film has such a low glass transition temperature (Tg), a conductive heating pattern may be formed without damaging an adhesive property in the bonding process or without unintendedly deforming or damaging the film using a method to be described later.

According to one embodiment of the present invention, when the adhesive film and the freestanding metal film are laminated passing through a heating roll at a [glass transition temperature of an adhesive film—10° C.] or greater, or a [temperature used in a bonding process with a transparent substrate] or less as necessary, adhesive strength between the adhesive film and the metal film suitably has a value of 250 gf/inch or greater. The adhesive strength may use a value measuring peeling strength of 90° under a condition of 300 mm/min using a texture analyzer apparatus (MHK trading company). When the adhesive strength has a value of less than 250 gf/inch, peeling may occur during a process of pattering the metal film. When the adhesive strength has a value of less than 250 gf/inch in the above process, adhesive strength may be improved by forming an adhesion improvement layer on the freestanding metal film or the adhesive film, or through plasma treatment.

According to one embodiment of the present invention, when the adhesive film and the freestanding metal film are laminated passing through a heating roll at a [glass transition temperature of an adhesive film—10° C.] or higher, or a [temperature used in a bonding process with a transparent substrate] or less as necessary, the contacted area of the adhesive film and the freestanding metal film increases compared to when the adhesive film and the metal film are laminated at less than a [glass transition temperature of an adhesive film—10° C.]. This is due to the fact that, when a composite film of an adhesive film/a metal film is prepared, lamination passing through a heating roll is carried out at a [glass transition temperature of an adhesive film—10° C.] or higher, or a [temperature in a bonding process with a transparent substrate] or less as necessary, for example, 150° C. or less, and as a result, the portion of the adhesive film surface in contact with the freestanding metal film is melted, and as a result, and the adhesion area between the conductive heating pattern and the adhesive film increases, which accordingly leads to the increase in the adhesive strength. Therefore, in the heating element according to one example of the present invention, the contacted area of the adhesive film and the conductive heating pattern may increase compared to when the adhesive film and the conductive heating pattern are laminated at less than a [glass transition temperature of an adhesive film—10° C.].

According to one embodiment of the present invention, the line height of the conductive heating pattern is 10 micrometers or less. When the thickness of the conductive heating pattern is greater than 10 micrometers, there is a disadvantage in that metal awareness increases by light reflection caused by the side of the metal pattern. According to one embodiment of the present invention, the line height of the conductive heating pattern is within the range of 0.3 to 10 micrometers. According to one embodiment of the present invention, the line height the conductive heating pattern is within the range of 0.5 to 5 micrometers.

According to one embodiment of the present invention, the conductive heating pattern is formed with metals. The conductive heating pattern having a line height of 10 micrometers or less may be formed by transferring a metal film formed using a plating method on an adhesive film by thermal bonding, and patterning the metal film as described above, or may be formed after forming a metal plating pattern on a metal layer and then transferring the result on an adhesive film. In the case that a method accompanying a high temperature process such as a vacuum deposition method is used when forming a conductive heating pattern is used, the film may be unintendedly deformed or damaged due the heat generated during the deposition process. When the film is unintendedly deformed or damaged, there is a limit in using a roll process.

As described above, conductivity of a specific resistance level of a metal itself may be obtained when a conductive heating pattern is formed using a plating method, compared to forming a conductive heating pattern with a printing method using a paste including a binder resin. In the case that a metal paste is used for example, 3 to 10 times of specific resistance is obtained compared to the specific resistance of the metal used, however, by using a plating method, the increase in the specific resistance may be controlled to be less than two times.

According to one embodiment of the present invention, the conductive heating pattern is formed from a freestanding metal film formed using a plating method, therefore, may include a catalyst used for metal plating. The catalyst capable of being used includes a catalyst including nickel, chromium, palladium or platinum, however, the catalyst is not limited thereto.

In the case that the conductive heating pattern is formed through a plating process after forming a seed layer on the adhesive film, a uniform metal film layer may not be obtained, therefore, as described above, using a method of preparing a freestanding metal film using a plating method, and then transferring the result on the adhesive film using a thermal bonding method is preferable considering the thickness uniformity of the conductive heating pattern.

The method using the freestanding metal film prepared with a plating method is as follows.

According to one example, the heating element according to the present invention may be fabricated using a method including heat bonding a metal film having a thickness of 10 micrometers or less on at least one surface of an adhesive film; and forming a conductive heating pattern by patterning the metal film.

The operation of heat bonding a metal film having a thickness of 10 micrometers or less on at least one surface of an adhesive film may include forming a metal plating layer on a metal layer; laminating the metal layer provided with the metal plating layer with the adhesive film so that the metal plating layer contacts with the adhesive film; and removing the metal layer from the metal plating layer. The metal layer may be used as a support layer for forming the metal plating layer.

As the operation of patterning the metal film, a conductive heating pattern having a line height of 10 micrometers or less may be formed after forming an etching protective pattern on the metal film, by removing the metal film that is not covered with the etching protective pattern.

The metal layer used as a support layer is not limited in its material and its thickness as long as it is capable of being used as a support layer of the metal plating layer. For example, the metal layer may use the same material as the metal plating layer.

The etching protective layer pattern may be formed by selective exposure and development using a photolithography method, or may be directly formed using a printing method. A gravure printing method, offset printing and the like may be used as the printing method, however, the printing method is not limited thereto.

The etching protective layer may be removed through a stripping process after forming the metal pattern, or may not be removed and remain thereon.

Figure 5:
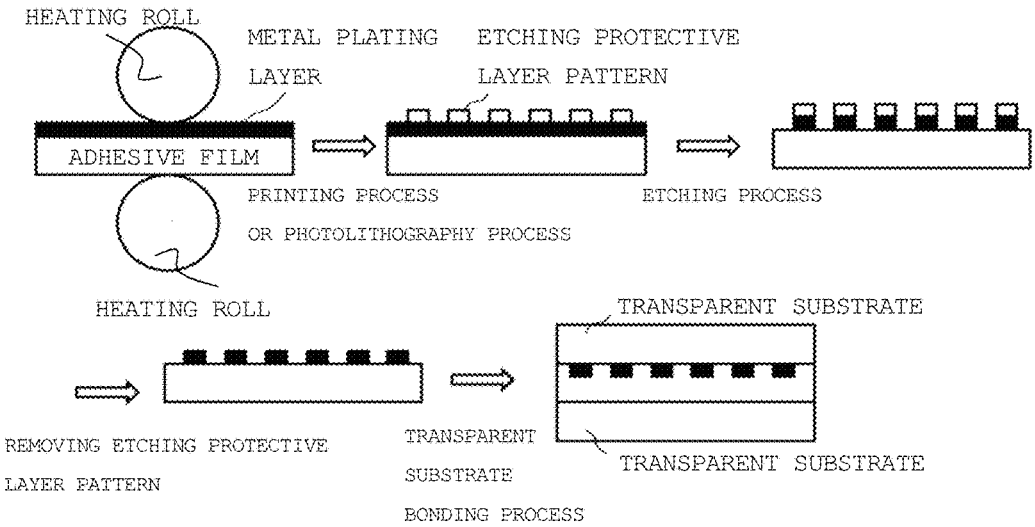
FIG. 5 illustrates a process for fabricating a heating element according to one embodiment described in the present specification.

A method for fabricating the heating element according to one example is illustrated in FIG. 5. According to FIG. 5, a metal film such as a copper film is thermally bonded on an adhesive film such as a PVB film, and an etching protective layer pattern is formed on the metal film using a printing process or lithography process, the metal film is etched, and then the etching protective layer pattern is removed. Subsequently, a first transparent substrate and a second transparent substrate are laminated on the both surfaces. Protective films may be attached instead of the transparent substrates as necessary. Although not shown in FIG. 5, a metal layer may be provided as a support layer on a surface opposite to the surface on which the metal film is thermally bonded, and the metal layer may be removed before laminating the transparent substrate.

According to another example, the heating element according to the present invention may be fabricated using a method including forming a metal plating pattern having a thickness of 10 micrometers or less on a metal layer; laminating the metal layer provided with the metal plating pattern with the adhesive film so that the metal plating pattern contacts with the adhesive film; and removing the metal layer from the metal plating pattern. Herein, for the metal layer, the descriptions made in the examples above may be applied.

For example, the operation of forming the metal plating pattern having a thickness of 10 micrometers or less on the metal layer may include forming a metal plating layer having a thickness of 10 micrometers or less on the metal layer; and forming the metal plating pattern by patterning the metal plating layer. The operation of forming the metal plating pattern by patterning the metal plating layer may be carried out after forming an etching protective layer pattern on the metal plating layer, by removing the metal plating layer that is not covered by the etching protective layer pattern. Herein, for the etching protective layer, the descriptions made in the examples above may be applied. When removing the metal plating layer that is not covered by the etching protective layer, the metal plating layer on the metal layer may be made to be removed by adjusting conditions such as an etching speed or an etching time.

Figure 6:
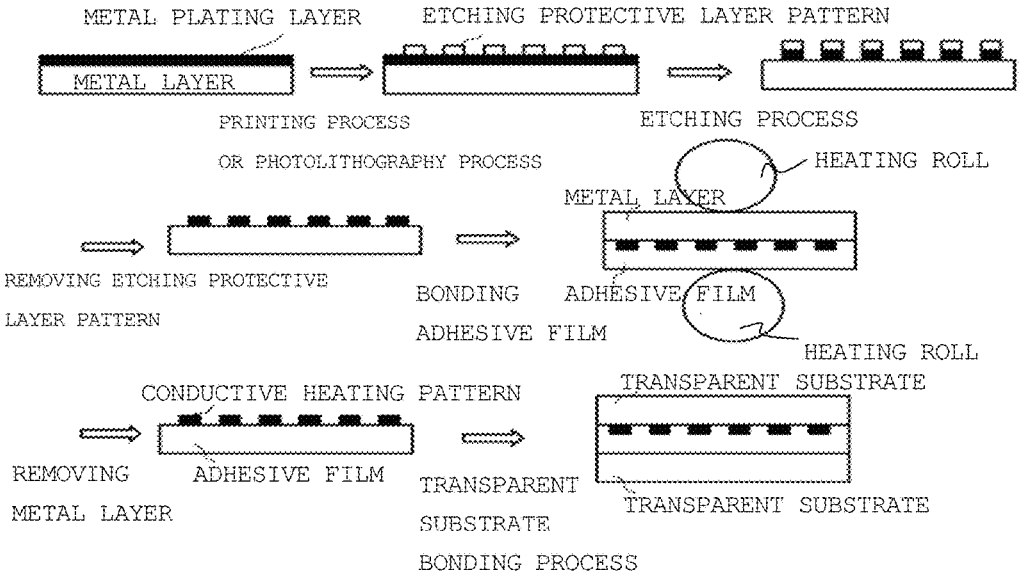
FIG. 6 illustrates a process for fabricating a heating element according to another embodiment described in the present specification.

A method for fabricating the heating element according to one example is illustrated in FIG. 6. According to FIG. 6, a metal plating pattern is formed by forming a metal plating layer on a metal layer, forming an etching protective layer pattern on the metal plating layer, and then removing the metal plating layer that is not covered by the etching protective layer pattern. Subsequently, the metal plating pattern formed on the metal layer is thermally bonded on an adhesive film, the metal layer is removed, and a first transparent substrate and a second transparent substrate are laminated on the both surfaces. Protective films may be attached instead of the transparent substrates as necessary.

As another example, the operation of forming the metal plating pattern having a thickness of 10 micrometers or less on the metal layer may include forming an insulation pattern on the metal layer; and forming a metal plating pattern having a thickness of 10 micrometers or less on the surface that is not covered by the insulation pattern of the metal layer. Herein, the insulation pattern maybe removed either before being laminated with the adhesive film, or after removing the metal layer from the metal plating pattern.

The insulation pattern is for forming a metal plating pattern, and materials selected from materials known in the art may be used as long as the materials are not against the purpose of the present invention.

Figure 7:
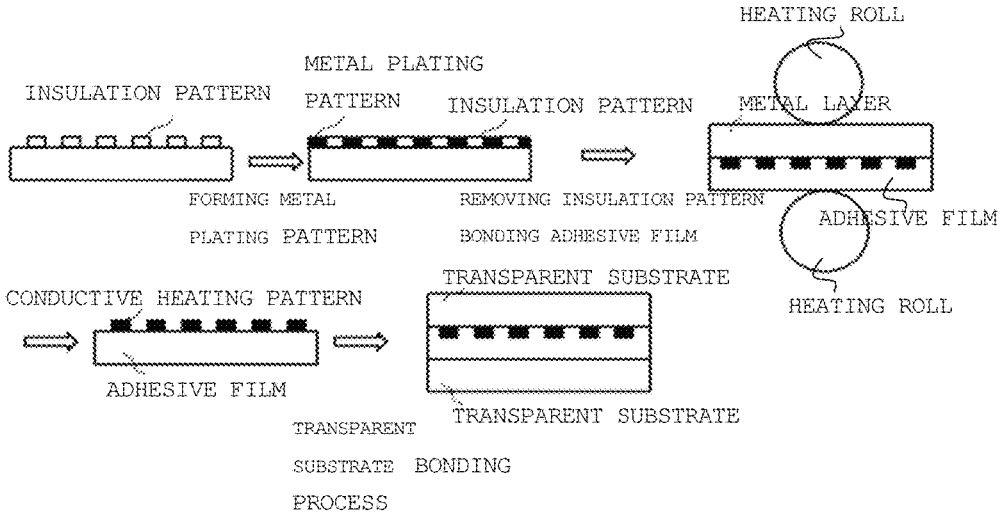
FIG. 7 illustrates a process for fabricating a heating element according to still another embodiment described in the present specification.

A method for fabricating the heating element according to one example is illustrated in FIG. 7. According to FIG. 7, an insulation pattern is formed on a metal layer, a metal plating pattern is formed on the surface of the metal layer not provided with the insulation pattern, the insulation pattern is removed, and an adhesive film is thermally bonded. Subsequently, the metal layer is removed, and a first transparent substrate and a second transparent substrate are laminated on the both surfaces. Protective films may be attached instead of the transparent substrates as necessary.

The methods for fabricating the heating element may further include forming bus bars at both ends of a conductive heating pattern; and forming a power unit connected to the bus bars.

According to one embodiment of the present invention, variations in the line height of the conductive heating pattern are less than 20%, and preferably less than 10%.

As necessary, a primer layer or a cohesive layer may be formed on the metal plating layer or the metal plating pattern, or on the adhesive film, before laminating the metal plating layer or the metal plating pattern on the adhesive film. An adhesive property with the adhesive film may be improved by the primer layer or the cohesive layer. The thinner the primer layer, the more preferable, and for example, the thickness is less than 10 micrometers, and preferably less than 1 micrometer. As the material of the primer layer, silicone series materials or acrylate series materials such as urethane acrylate may be used.

As necessary, plasma treatment may be carried out on a metal film such as the metal plating layer or the metal plating pattern, or the adhesive film in order to improve an adhesive property.

According to one embodiment of the present invention, a primer layer or a cohesive layer may be provided at the interface of the conductive heating pattern and the adhesive film.

According to one embodiment of the present invention, the conductive heating pattern may be formed with thermally conductive materials. For example, the conductive heating pattern may be formed with metal wires. Specifically, the heating pattern preferably includes metals having excellent thermal conductivity. The specific resistance value of the heating pattern material is favorably greater than or equal to 1 microohm cm and less than or equal to 200 microohm cm. Specific examples of the heating pattern material may include copper, silver, aluminum and the like. As the material of the conductive heating pattern, copper, which is inexpensive and has excellent electric conductivity, is most preferable.

The heating pattern may include a pattern of metal wires formed with straight lines, curves, zigzags or a combination thereof. The heating pattern may include regular patterns, irregular patterns or a combination thereof.

The total aperture ratio of the heating pattern is preferably 90% or greater.

According to one embodiment of the present invention, the line width of the heating pattern is 40 μm or less, and specifically 0.1 μm to 40 μm or less. The distance between the heating pattern lines is 50 μm to 30 mm.

Figure 2:
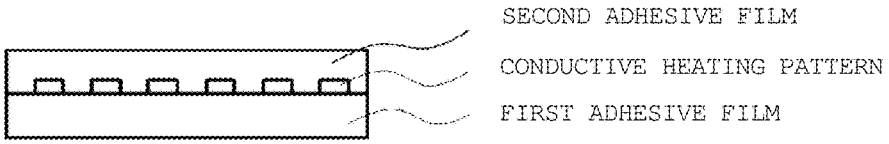
FIG. 2 illustrates a laminated structure in a heating element according to another embodiment described in the present specification.

According to another embodiment of the present invention, a heating element further including an additional adhesive film provided on the surface provided with the conductive heating pattern of the adhesive film of the heating element according to the embodiments described above is provided. In FIG. 2, a heating element including a first adhesive film; a conductive heating pattern provided on at least one surface of the adhesive film and having a line height of 10 micrometers or less; and a second adhesive film provided on the surface provided with the conductive heating pattern of the first adhesive film. In the art, a conductive heating pattern is formed on a plastic film such as a PET film, and, in order to attach the result to a substrate such as transparent glass, adhesive films are attached on the both surfaces. However, according to the embodiment of the present invention, a conductive heating pattern is directly used on an adhesive film without a plastic film, therefore, the use of a plastic film such as a PET film is not required, and accordingly, a view distortion phenomenon caused by a refractive index difference between the adhesive film and the plastic film may be prevented. In addition, when protective films or transparent substrates are bonded to both sides of a heating element, bubble removal may be difficult when a non-even area such as an embossed area is not at all present on the surface of the heating element. However, in the case that a heating element having a structure including a first adhesive film and a second adhesive film as described above is used, the problem of the difficult bubble removal described above may be eased. For the additional adhesive films, the descriptions on the adhesive film made in the present specification may be applied. In addition, the two adhesive films may be formed with the same type or different types of materials. Furthermore, the thickness of the two adhesive films may be the same as each other, or different from each other as necessary.

Figure 3:
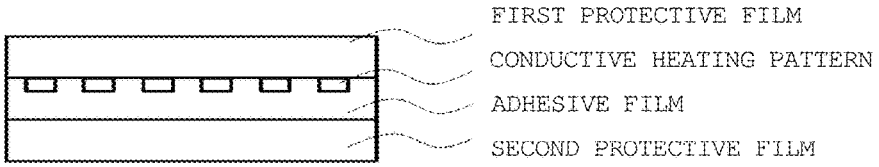
FIG. 3 illustrates a laminated structure in a heating element according to still another embodiment described in the present specification.

According to another embodiment of the present invention, a heating element including an adhesive film; a conductive heating pattern provided on at least one of the adhesive film, and having a line height of 10 micrometers or less; a protective film provided on at least one surface of the surface provided with the conductive heating pattern of the adhesive film, and a surface opposite to the surface provided with the conductive heating pattern of the adhesive film is provided. In FIG. 3, a laminated structure of a heating element including two protective films is illustrated.

As described above, a conductive heating pattern may be directly prepared on an adhesive film without a substrate in the present invention, therefore, depending on the requirements in terms of processes, or the form of an end use application, the heating element may be formed with protective films to be removed later attached thereto without attaching transparent substrates. As the types of the protective film, those known in the art may be used.

Figure 4:
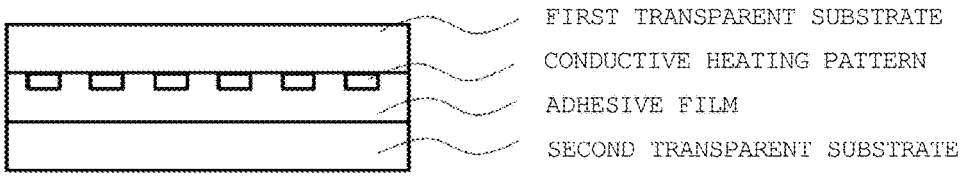
FIG. 4 illustrates a laminated structure in a heating element according to still another embodiment described in the present specification.

According to another embodiment of the present invention, a heating element including an adhesive film; a conductive heating pattern provided on at least one surface of the adhesive film and having a line height of 10 micrometers or less; a first transparent substrate provided on the surface provided with the conductive heating pattern of the adhesive film; and a second transparent substrate provided on a surface opposite to the surface provided with the conductive heating pattern of the adhesive film. In FIG. 4, a laminated structure of a heating element including two transparent substrates is illustrated.

According to one embodiment of the present invention, the first transparent substrate and the conductive heating pattern contact with each other, and the second transparent substrate and the adhesive film contact with each other.

The first and the second transparent substrates preferably have visible light transmittance of 50% or higher, and preferably 75% or higher. Specifically, glass may be used as the transparent substrate, or a plastic substrate or a plastic film may be used.

As the plastic substrate or film, material known in the art may be used, and for example, films having visible light transmittance of 80% or greater such as polyethylene terephthalate (PET), polyvinylbutyral (PVB), polyethylene naphthalate (PEN), polyethersulfon (PES), polycarbonate (PC) and acetyl celluloid are preferable. The thickness of the plastic film is preferably 12.5 μm to 500 μm, and more preferably 30 μm to 250 μm.

The transparent substrate may have a shape forming a curved surface depending on the application.

According to another embodiment of the present invention, the heating element further includes a pair of bus bars opposite to each other in order to apply electricity to the conductive heating pattern.

According to another embodiment of the present invention, a black pattern may be provided in order to mask the bus bars. For example, the black pattern may be printed using a paste containing cobalt oxide. Herein, screen printing is suitable as the printing method, and the thickness may be set at 10 μm to 100 μm. The heating pattern and the bus bars may be each formed either before or after forming the black pattern.

According to another embodiment of the present invention, the heating element is a window for vehicles.

According to another embodiment of the present invention, the heating element is a front window for vehicles.

The heating element according to the present invention may be connected to power for heating, and herein, the heat value may be 100 to 1000 W per $m^2$, and preferably 200 to 700 W. The heating element according to the present invention has excellent heating efficiency under a low voltage such as 30 V or less and preferably 20 V or less, therefore, may be favorably used in vehicles and the like. The resistance in the heating element is 2 ohm/square or less, preferably 1 ohm/square or less, and more preferably 0.5 ohm/square or less. Herein, the obtained resistance value has the same meaning as surface resistance.

According to one embodiment of the present invention, the method for fabricating the heating element may further include adhering a first protective film on the surface formed with the conductive heating pattern of the adhesive film, and adhering a second protective film on a surface opposite to the surface formed with the conductive heating pattern of the adhesive film. The adhesion of the first protective film and the second protective film may be carried out either simultaneously or consecutively.

According to one embodiment of the present invention, the method for fabricating the heating element may further include laminating a first transparent substrate on the surface formed with the conductive heating pattern of the adhesive film, and laminating a second transparent substrate on a surface opposite to the surface formed with the conductive heating pattern of the adhesive film. The operation of laminating the first transparent substrate and the operation of laminating the second transparent substrate may be carried out either simultaneously or consecutively.

The process of laminating the first transparent substrate and the second transparent substrate with the adhesive film provided with the conductive heating pattern may be carried out as follows.

First bonding is carried out by inserting the adhesive film formed with the conductive heating pattern between the two transparent substrates, and removing air by either increasing the temperature by placing the result in a vacuum bag and reducing the pressure, or increasing the temperature using a heating roll. Herein, the pressure, temperature and time are different depending on the types of the adhesive film, however, under normal circumstances, the temperature may be gradually raised from room temperature to 100° C. under a pressure of 300 to 700 torr. Herein, the time is preferably set to be less than 1 hour. The pre-bonded laminated body after the first bonding goes through a second bonding process by an autoclaving process in which a temperature is raised while applying a pressure in an autoclave. The second bonding may be carried out for, although varied depending on the types of the adhesive film, 1 to 3 hours and preferably for 2 hours under a pressure of 140 bar or greater and a temperature of 130 to 150° C., and then slowly cooling the result.

In another specific embodiment, a method of one-step bonding may be used with a vacuum laminator apparatus instead of the two-step bonding process described above. The bonding may be carried out by gradually increasing the temperature up to 80 to 150° C. and, while slowly cooling, depressurizing up to 100° C. (~5 mbar), and then pressurizing (~1000 mbar) after that.

Hereinafter, the present invention will be described in more detail with reference to specific examples.

Example 1

Figure 8:
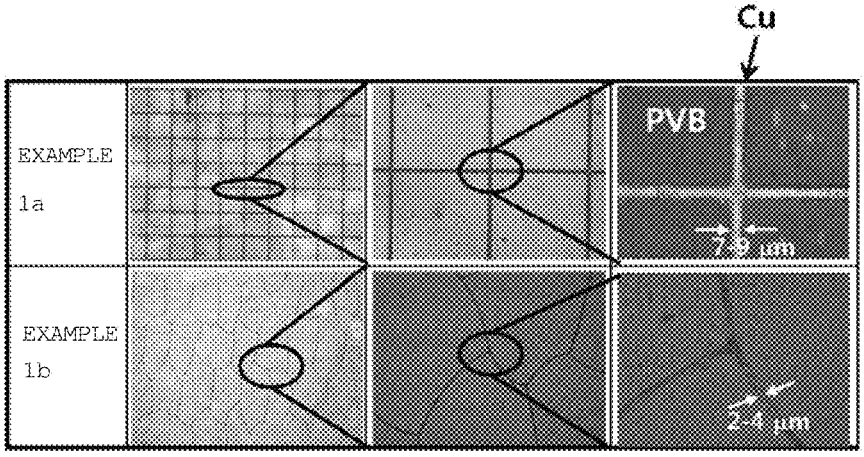
FIG. 8 shows a photograph of a conductive heating pattern form of a heating element prepared in Example 1.

A copper plating layer was faced to a PVB film using a film in which a copper plating layer having a thickness of 2 micrometers was formed on a copper film having a thickness of 18 micrometers, and the result was laminated at 70 to 150° C. that is near 80° C., a glass transition temperature (Tg) of PVB. Subsequently, the copper film having a thickness of 18 micrometers was removed, and then an etching protective layer pattern having a novolac resin as a main component was formed on the copper film using a reverse offset printing process. After additionally drying the result for 5 minutes at 60 to 70° C., a copper pattern was formed on the PVB film by etching the exposed part of the copper through an etching process. Herein, the linewidth of the copper pattern was 1 to 10 micrometers, however, the copper line width may be varied depending on the experimental conditions and the printing plates used. The copper pattern of the prepared heating element is shown in FIG. 8. Through such an example, it was identified that a heating element including a metal pattern having a line height of 10 micrometers or less as a conductive heating pattern may be fabricated.

Example 2

Figure 9:
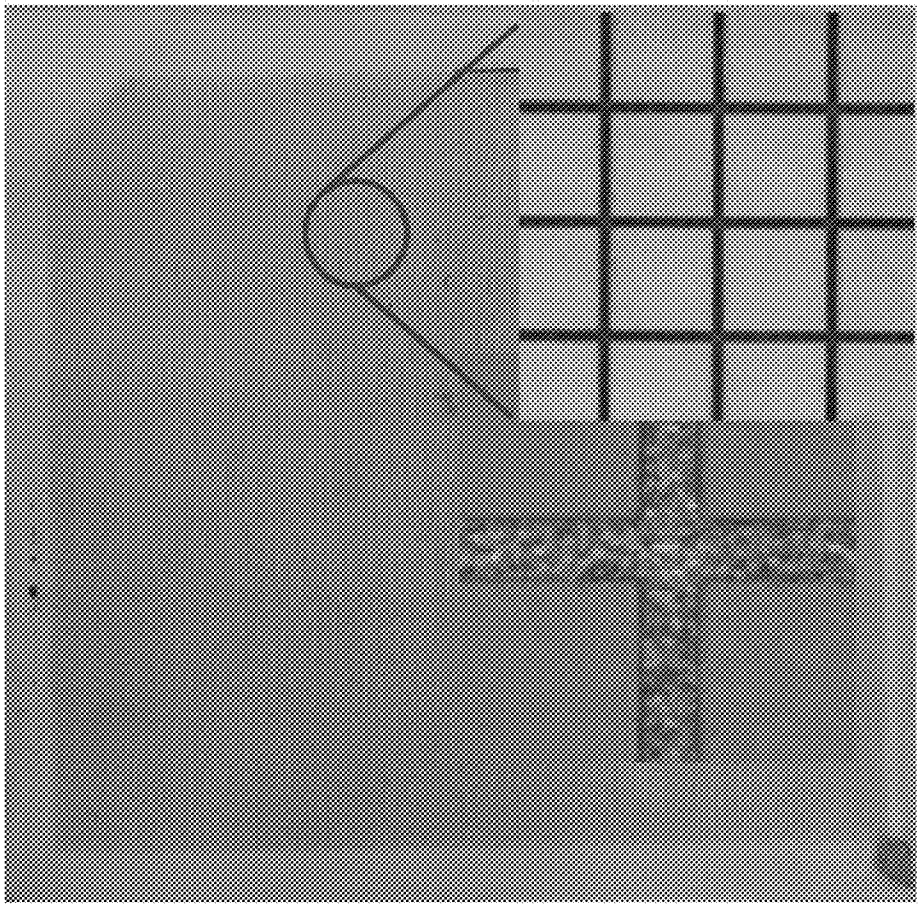
FIG. 9 shows a photograph of a conductive heating pattern form of a heating element prepared in Example 2.

An etching protective layer pattern having a novolac resin as a main component was formed on a 2 micrometer copper plating layer using a film in which a copper plating layer having a thickness of 2 micrometers is formed on a copper foil having a thickness of 18 micrometers. The result was dried for 5 minutes at 140° C. Then, of the copper plating layer having a thickness of 2 micrometers, the part that was not covered with the etching protective layer was etched by being etched for 30 to 48 seconds using an etching process with a copper etching rate of 2.5 to 4 μm/min, and subsequently, the remaining etching protective layer was removed using an organic amine-based peeling liquid, and as a result, a copper pattern having a line height of 2 micrometers was formed. After that, a PVB film was laminated on glass, and lamination was carried out at 120° C. after facing the copper pattern with the PVB film. Subsequently, the copper foil having a thickness of 18 micrometers was removed, and as a result, a copper pattern having a line height of 2 micrometers was formed on the PVB film, and this is shown in FIG. 9. Herein, the line width and the pitch of the copper pattern were 33.5 micrometers and 200 micrometers, respectively, and the surface resistance was approximately 0.17 ohm/sq.

Example 3

Figure 10:
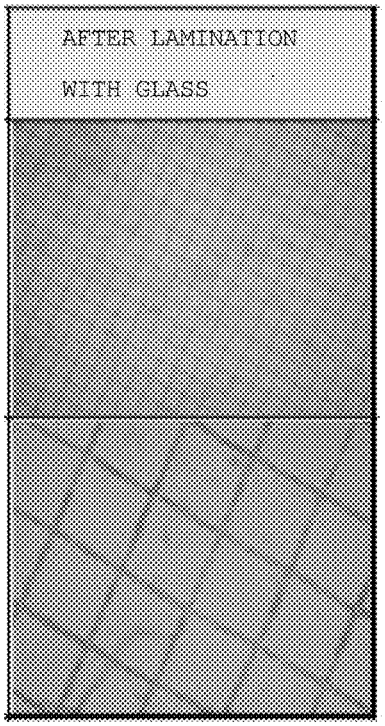
FIG. 10 shows a photograph of a conductive heating pattern form of a heating element prepared in Example 3.

A heating element was fabricated in the same manner as in Example 1, except that an acryl-based cohesive layer was coated on the PVB, and the drying condition after forming the etching protective layer pattern was for 3 minutes at 115° C. instead of 5 minutes at 60 to 70° C., and laminating the result with glass. Herein, the linewidth of the copper pattern was 1 to 10 micrometers, however, the copper line width may be varied depending on the experimental conditions and the printing plates used. The copper pattern of the prepared heating element is shown in FIG. 10. Through such an example, it was identified that a heating element including a metal pattern having a line height of 10 micrometers or less as a conductive heating pattern may be fabricated.

Example 4

A copper plating layer was faced to a EVA film using a film in which a copper plating layer having a thickness of 2 micrometers is formed on a copper foil having a thickness of 18 micrometers, and the result was laminated at 90° C.

Figure 11:
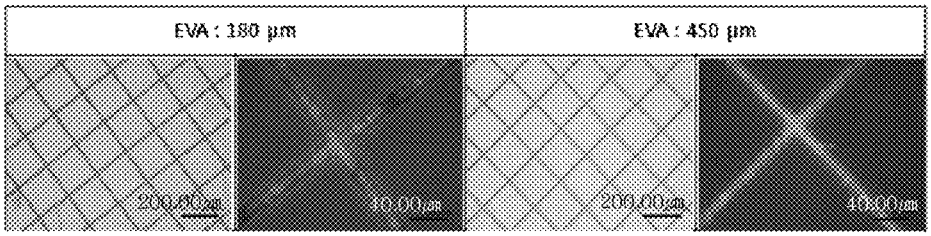
FIG. 11 shows a photograph of a conductive heating pattern form of a heating element prepared in Example 4.

Subsequently, the copper film having a thickness of 18 micrometers was removed, and then an etching protective layer pattern having a novolac resin as a main component was formed on the copper film using a reverse offset printing process. After additionally drying the result for 5 minutes at 60 to 70° C., a copper pattern was formed on the EVA film by etching the exposed part of the copper through an etching process and removing the etching protective layer using a peeling liquid. After that, the result was laminated with glass to fabricate a heating element. Herein, the linewidth of the copper pattern was 1 to 10 micrometers, however, the copper line width may be varied depending on the experimental conditions and the printing plates used. The copper pattern and the optical property of the prepared heating element are shown in FIG. 11. Through such an example, it was identified that a heating element including a metal pattern having a line height of 10 micrometers or less as a conductive heating pattern may be fabricated.

Physical properties of the transparent heating element fabricated according to Example 4 were shown in the following Table 1 compared to a reference having no metal pattern.

TABLE 1

| | Transparent Heating Element | | Reference (No Metal Pattern) | |
|---|---|---|---|---|
| EVA Film Thickness [μm] | 180 | 450 | 180 | 450 |
| Total Light Transmittance Tt (%) | 78.9 | 78.4 | 92.1 | 90.0 |
| Haze (%) | 5.8 | 5.2 | 0.9 | 3.1 |
| Yellow Index b* | 1.63 | 1.37 | 0.53 | 0.95 |

The invention claimed is:

1. A heating element comprising:

a freestanding adhesive film of polyvinylbutyral (PVB), ethylene vinyl acetate (EVA), polyurethane (PU) or polyolefin (PO) not attached to a substrate; and a conductive heating pattern provided on at least one surface of the adhesive film and having a line height of 10 micrometers or less, wherein the conductive heating pattern is a patterned metal film, wherein a specific resistance of the conductive heating pattern is twice or less compared to a specific resistance of a metal forming the conductive heating pattern, and wherein the conductive heating pattern is plated and includes a plating catalyst.

2. A heating element comprising:

a freestanding adhesive film of polyvinylbutyral (PVB), ethylene vinyl acetate (EVA), polyurethane (PU) or polyolefin (PO) not attached to a substrate;

a conductive heating pattern provided on at least one surface of the adhesive film and having a line height of 10 micrometers or less; and a removable protective film provided on at least one surface of the surface provided with the conductive heating pattern of the adhesive film, and a surface opposite to the surface provided with the conductive heating pattern of the adhesive film, wherein the conductive heating pattern is a patterned metal film, wherein a specific resistance of the conductive heating pattern is twice or less compared to a specific resistance of a metal forming the conductive heating pattern, and wherein the conductive heating pattern is plated and includes a plating catalyst.

3. The heating element of claim 1, further comprising an additional adhesive film provided on the surface provided with the conductive heating pattern of the adhesive film.

4. The heating element of claim 1, wherein a thickness of the adhesive film is 190 to 2,000 micrometers.

5. The heating element of claim 1, wherein a glass transition temperature (Tg) of the adhesive film is 55 to 90° C.

6. The heating element of claim 1, wherein a variation in the line height of the conductive heating pattern is 20% or less.

7. The heating element of claim 1, further comprising a primer layer or a cohesive layer provided at an interface of the conductive heating pattern and the adhesive film.

8. A window for vehicles comprising the heating element of claim 1, wherein the freestanding adhesive film is adhered to a substrate.

9. A method for fabricating a heating element including forming a conductive heating pattern having a line height of 10 micrometers or less on at least one surface of an adhesive film of polyvinylbutyral (PVB), ethylene vinyl acetate (EVA), polyurethane (PU) or polyolefin (PO) not attached to a substrate prior to adhering the adhesive film onto a substrate, wherein the conductive heating pattern is a patterned metal film, wherein the operation of forming the metal film conductive heating pattern having a line height of 10 micrometers or less on at least one surface of the adhesive film includes forming a metal plating pattern having a thickness of 10 micrometers or less on a metal layer; laminating the metal layer provided with the metal plating pattern with the adhesive film so that the metal plating pattern contacts with the adhesive film; and removing the metal layer from the metal plating pattern, further comprising adhering a first protective film to the surface formed with the conductive heating pattern of the adhesive film, and adhering a second protective film to a surface opposite to the surface formed with the conductive heating pattern of the adhesive film, wherein a specific resistance of the conductive heating pattern is twice or less compared to a specific resistance of a metal forming the conductive heating pattern, and wherein the conductive heating pattern is formed by metal plating and includes a plating catalyst.

10. The method for fabricating a heating element of claim 9, wherein the operation of forming the conductive heating pattern having a line height of 10 micrometers or less on at least one surface of the adhesive film includes heat bonding the metal film having a thickness of 10 micrometers or less on at least one surface of the adhesive film; and forming the conductive heating pattern by patterning the metal film.

11. The method for fabricating a heating element of claim 10, wherein the operation of heat bonding the metal film having a thickness of 10 micrometers or less on at least one surface of the adhesive film includes forming a metal plating layer on a metal layer; laminating the metal layer provided with the metal plating pattern with the adhesive film so that the metal plating pattern contacts with the adhesive film; and removing the metal layer from the metal plating pattern.

12. The method for fabricating a heating element of claim 9, wherein the operation of forming the metal plating pattern having a thickness of 10 micrometers or less on the metal layer includes forming a metal plating layer having a thickness of 10 micrometers or less on the metal layer; and forming the metal plating pattern by patterning the metal plating layer.

13. The method for fabricating a heating element of claim 9, wherein the operation of forming the metal plating pattern having a thickness of 10 micrometers or less on the metal layer includes forming an insulation pattern on the metal layer; and forming the metal plating pattern having a thickness of 10 micrometers or less on a surface that is not covered by the insulation pattern of the metal layer, wherein the insulation pattern is removed either before being laminated with the adhesive film, or after removing the metal layer from the metal plating pattern.

14. The method for fabricating a heating element of claim 11, further comprising forming a primer layer or a cohesive layer on the adhesive film, or on the metal plating layer or the metal plating pattern before the lamination.

15. The method for fabricating a heating element of claim 11, wherein the lamination is carried out using a lamination process passing through a heating roll at a [glass transition temperature (Tg) of the adhesive film−10° C.] or more.

16. The method for fabricating a heating element of claim 9, further comprising forming a primer layer or a cohesive layer on the adhesive film, or on the metal plating layer or the metal plating pattern before the lamination.

* * * * *